US007316369B2

(12) United States Patent
Phelps

(10) Patent No.: US 7,316,369 B2
(45) Date of Patent: Jan. 8, 2008

(54) CORELESS ROLL PRODUCT ADAPTER FOR RECESSED DISPENSERS

(75) Inventor: Stephen L. Phelps, Lilburn, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 89 days.

(21) Appl. No.: 11/379,878

(22) Filed: Apr. 24, 2006

(65) Prior Publication Data

US 2007/0267532 A1 Nov. 22, 2007

(51) Int. Cl.
*B65H 49/18* (2006.01)

(52) U.S. Cl. ..... 242/596.4; 242/596.7; 242/596.8

(58) Field of Classification Search ..... 242/596, 242/596.3, 596.4, 596.7, 596.8, 599.3
See application file for complete search history.

(56) References Cited

U.S. PATENT DOCUMENTS

| | | | | |
|---|---|---|---|---|
| 390,084 | A | 9/1888 | Lane | |
| 1,772,917 | A | 8/1930 | Sifferman | |
| 2,790,608 | A | 4/1957 | Sieven | |
| 2,905,404 | A | 9/1959 | Simmons | |
| 3,706,421 | A | 12/1972 | Popham | |
| 5,464,170 | A | 11/1995 | Mitchell et al. | |
| 5,718,404 | A | 2/1998 | Greer | |
| 5,848,762 | A | 12/1998 | Reinheimer et al. | |
| 5,904,316 | A | 5/1999 | Dunning et al. | |
| D428,286 | S | 7/2000 | Phelps et al. | |
| 6,082,664 | A | 7/2000 | Phelps et al. | |
| 6,092,758 | A | 7/2000 | Gemmell | |
| 6,092,759 | A | 7/2000 | Gemmell et al. | |
| 6,138,939 | A | 10/2000 | Phelps et al. | |
| 6,360,985 | B1 | 3/2002 | Phelps et al. | |
| 6,382,553 | B1 | 5/2002 | Lewis et al. | |
| 6,386,479 | B1 * | 5/2002 | Lewis et al. | 242/596.8 |
| 6,439,502 | B1 * | 8/2002 | Gemmell et al. | 242/596.3 |
| 6,592,068 | B2 * | 7/2003 | Taylor et al. | 242/596.8 |
| 6,666,364 | B2 | 12/2003 | Phelps | |

FOREIGN PATENT DOCUMENTS

| | | | |
|---|---|---|---|
| GB | 2294681 | A | 5/1996 |

* cited by examiner

*Primary Examiner*—William A Rivera
(74) *Attorney, Agent, or Firm*—Nathan P. Hendon

(57) ABSTRACT

An adapter for dispensing coreless or solid rolled product from an existing recessed roll product dispenser is disclosed. The adapter also allows for rolled product to be dispensed from the existing recessed dispenser where the rolls being dispensed may have a larger diameter than allowed by the recessed dispenser without the adapter. A system for dispensing coreless or solid rolled product from an existing recessed dispenser is also disclosed.

19 Claims, 6 Drawing Sheets

CORELESS ROLL PRODUCT ADAPTER FOR RECESSED DISPENSERS

BACKGROUND

Commercial and consumer absorbent products such as shop towels, nonwoven fabrics, wipers, toilet tissue and paper towels are often distributed and dispensed in roll format. Most products in this format include a cylindrical core at the center of the roll and the product is wrapped about the core. Most roll format product dispensers require this core to function properly. The core is usually some type of cardboard tube, plastic tube, or solid spindle which is glued to the product so that the product does not separate from the core.

Rolled product is normally loaded by mounting the roll on a spindle in a manner similar to the ubiquitous bathroom toilet roll dispenser. The spindle passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively Recently, coreless rolls and solid rolls of products such as, for example, toilet tissue and paper towel have appeared on the market. These coreless and solid rolls are wound throughout the entire diameter of the roll. There are advantages and disadvantages associated with the coreless and solid rolls. Coreless and solid rolls are ecologically superior to cored rolls because they lack the central core made of plastic, cardboard or other material. In addition, more product can be provided in the space that would otherwise have been occupied by the core.

Cored rolls are more expensive to manufacture than coreless and solid rolls because of the expense of making the cores and joining the cores to the product. In addition, coreless and solid rolls have the advantage of being less subject to pilferage in commercial locations because of their inherent incompatibility with conventional dispensers.

On the other hand, coreless and solid roll products have dispensing problems that are difficult to overcome. Coreless and solid rolls do not fit into conventional cored roll dispensers as conventional cored roll dispensers rely on the use of a spindle integrated with the dispenser design. Additionally, it is often desired that the advantages of solid and coreless rolls be maximized by further increasing the amount of rolled material by also increasing the diameter of the solid or coreless roll. Such an increase in diameter also increases the difficulty in dispensing such rolls from existing dispensers.

The problem with the coreless roll products fitting into existing dispenser is even greater for dispensers that are partially recessed. Recessed dispensers are often found within professional workplace restrooms and other commercial settings. Such recessed dispensers reduce the degree that the diameter of the rolled product protrudes from the dispenser and partially protect the roll from the environment in which the dispenser resides. In many such recessed dispensers, the spindle lies in the dispensing cavity such that over half of the roll diameter lies within the cavity.

FIG. 1 shows an exemplary recessed dispenser 90 for roll product and illustrates features common to many existing recessed dispensers. Specifically, the dispenser 90 shown is a dispenser for rolled toilet tissue. While shown for toilet tissue, such exemplary recessed dispensers are similar in general design to recessed dispensers of other rolled products such as towels, wipers and the like. In all such dispensers, there is a recessed dispensing cavity 96 in which at least a portion of the roll diameter resides. The opening periphery 94 to the recessed dispensing cavity 96 is of a shape and size appropriate for the cored roll product being dispensed. Often, as shown in FIG. 1, the cored roll product is dispensed using a spindle, the ends of which reside in two opposing spindle guide recesses 99 that are in the side walls 97 of the dispensing cavity 96 toward the front of the dispensing cavity 96. As such, over half of the diameter of a undispensed roll of cored roll product will reside within the dispensing cavity 96 prior to dispensing. To properly dispense the cored roll product, the cavity 96 is sized so that such a roll may be contained in the recess, rotate within the cavity 96, and be dispensed therefrom.

Such recessed dispensers 90 are particularly limited in size and prevent the use of larger rolls. The dispensing cavity 96, in which a portion of the roll will reside, determines the size of roll. Additionally the dimension of the cavity 96 (i.e., depth and interior shape/clearances) may also limit roll size. This is especially true for partition mounted dispenser where the interior space is limited by the limited space available of such dispenser designs.

Adapters exist to convert cored dispensers to dispense coreless or solid rolls but none address the unique difficulties associated with using a larger than standard roll of coreless or solid roll product in a recessed dispensing cavity. Additionally, many such adapters require multi-step installation and have multiple parts which increases the complexity of the adapter and increases the number of parts that may malfunction. Finally, such adapters do not maintain the aesthetic character of the original dispenser that is being adapted.

SUMMARY OF THE INVENTION

In light of the problems and issues discussed above, it is desired to have an adapter for use with existing recessed dispensers to dispense coreless or solid rolls therefrom. There is also a need to dispense larger than standard coreless or solid rolled product from existing recessed cored roll dispensers. It is further desired that such an adapter be easy to install and simple in design to avoid the complication of multiple parts.

The present invention is directed to an adapter for solid or coreless roll products that are dispensed from a recessed dispenser where the adapter has a frame adapted to be attached to the recessed dispenser and a pair of roll adapters attached to the frame. The frame is made up of a pair of tabs that oppose each other and extend into the recessed dispensing cavity of the recessed dispenser, a pair of arms that oppose each other and each extending from the tabs and outwards from the dispensing cavity, and a traverse cross-member that connects the pair of tabs. The roll adapters are attached to the frame at the distal ends of the arms and opposite of each other, such that they can engage, hold and dispense a solid or coreless roll.

In various embodiments of the present invention, the various parts of the frame may be made of a single piece of material, mounts that attach the frame to the dispensing cavity may be present on the tabs, and, or alternatively, mounts may be present on the traverse cross-member. Additionally, or alternatively, the frame may include a roll cover. In some embodiments, the roll adapters may have a protrusion adapted to displace when a greater opposing force is applied against its distal end of the protrusion during loading of a rolled product and apply force to the rolled product when the greater opposing force is removed during dispensing. Such roll adapters protrusions may be adapted to displace with the directional forces applied during insertion of the rolled product into the adapter, but does not displace with application of directional forces opposite to those applied during insertion of the rolled product into the adapter.

The present invention is also directed to a system for dispensing solid or coreless roll products from a recessed dispenser having a dispensing cavity. The system includes a solid or coreless roll of product, an adapter having a frame and a pair of roll adapters attached to the frame, and a mount that attaches the adapter to the recessed dispenser.

DETAILED DESCRIPTION

Figure 1:
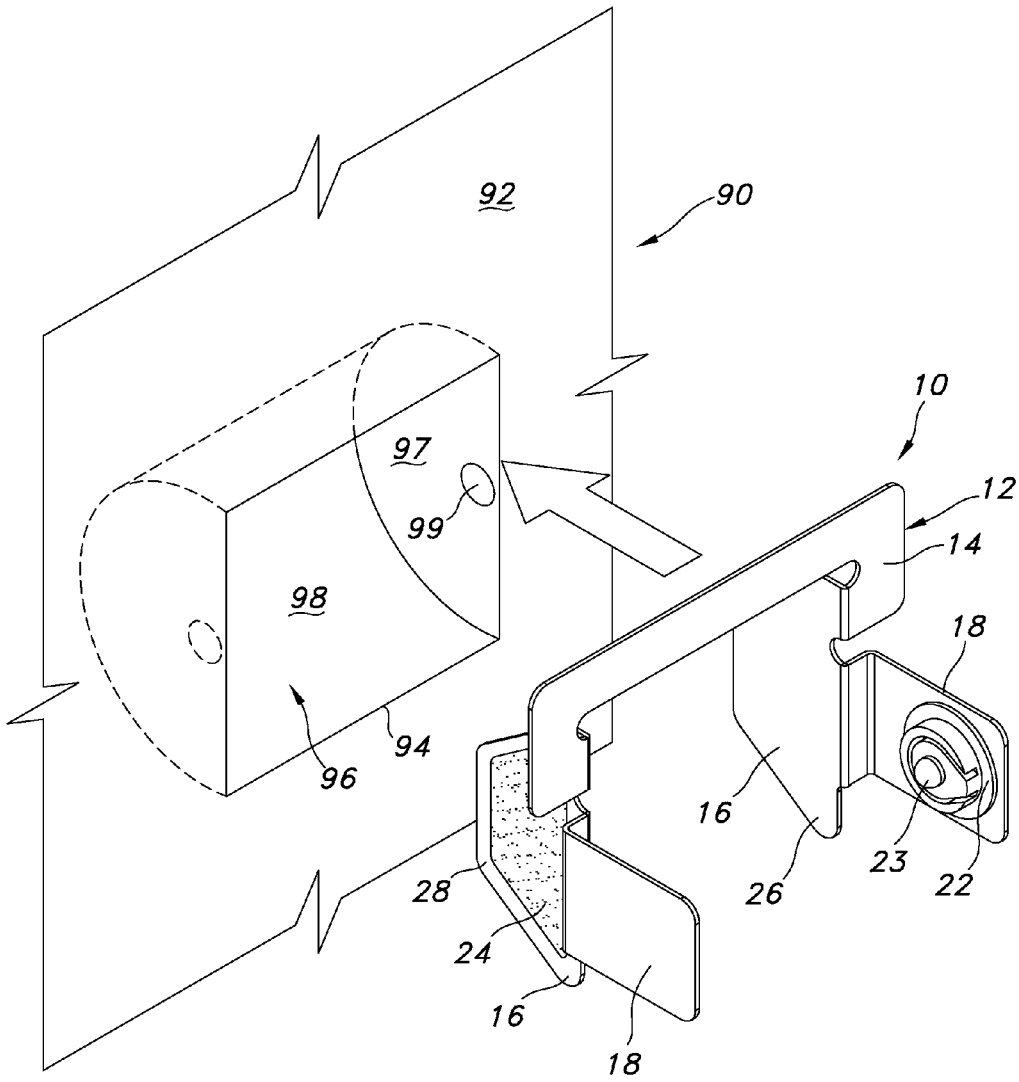
FIG. 1 is a perspective view of an exemplary recessed dispenser and an adapter according to the present invention.

Reference will now be made in detail to various embodiments of the invention, one or more examples of which are illustrated in the drawings. Each example is provided by way of explanation of the invention and is not meant as a limitation of the invention. For example, features illustrated or described as part of one embodiment can be used in another embodiment to yield still a further embodiment. It is intended that the present invention covers such modifications and variations coming within the scope and spirit of the invention.

For illustrative purposes, the present invention will be described and illustrated as it relates to solid or coreless rolls of bathroom tissue. However, this should not be interpreted as a limitation of the invention. It should be understood and appreciated that the present invention has uses in any application wherein solid or coreless rolls of material, and not necessarily paper material, are to be dispensed form a dispensing device. Some other materials include, for example, non-woven fabrics, films, textiles, screens, meshes, and composite or laminates including one or more of the above. These types of materials may be in the form of various products which may include, by way of non-limiting examples, such products as bathroom tissue, paper towels, towels, wet wipes, dry wipers, sheets, coverings, and the like.

The term "coreless" refers to rolls not having a hollow tube or hollow core through which a spindle device may be inserted. Thus, a roll of material having a solid or non-hollow core is referred to herein as a coreless roll. Additionally, a roll of material which is wound substantially through its diameter and having a central aperture which extends along the winding axis is also considered to be a coreless roll.

Figure 2:
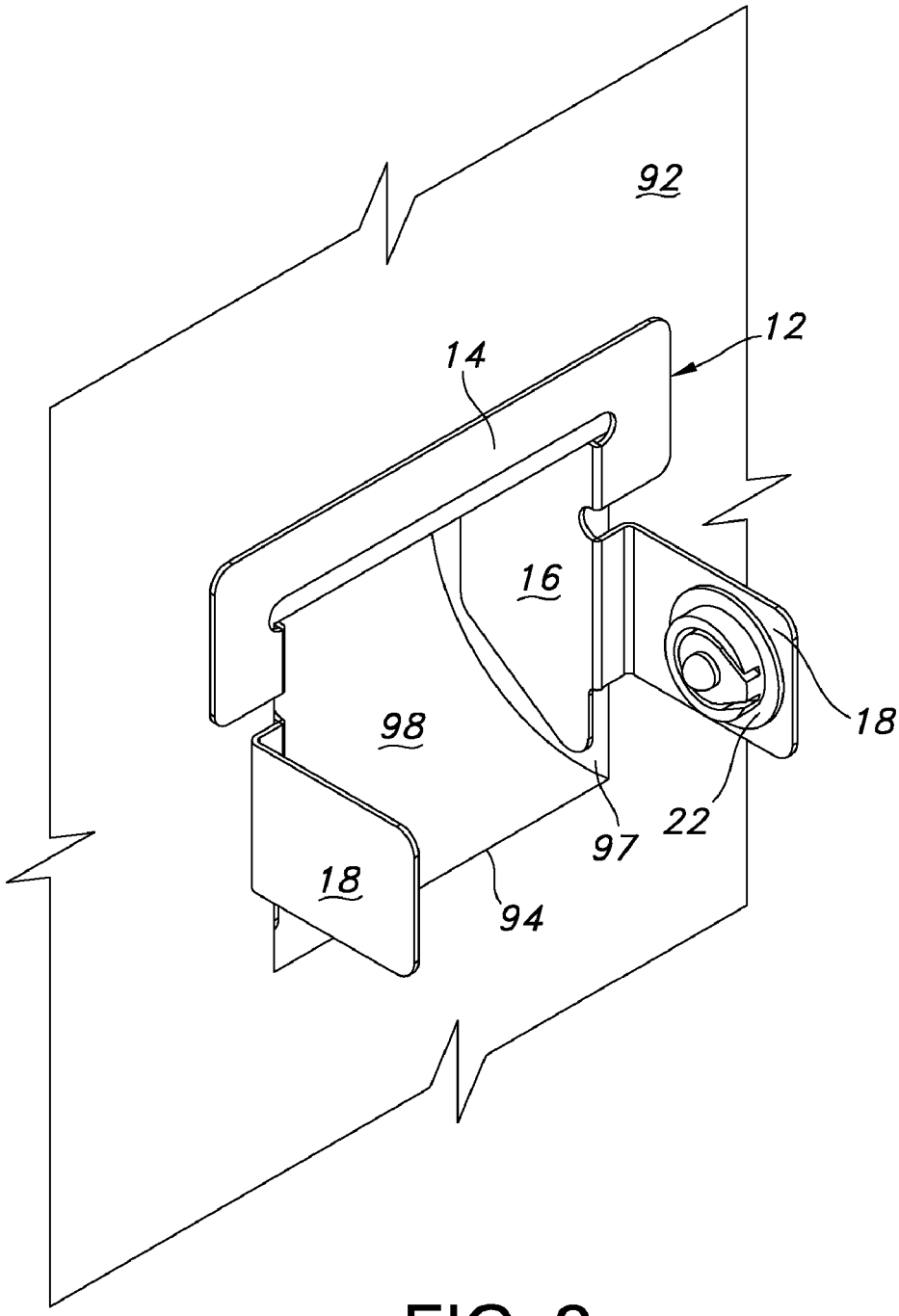
FIG. 2 is a perspective view of an adapter of the present invention installed in an exemplary recessed dispenser.

FIGS. 1 and 2 conceptually illustrate the present invention. An exemplary adapter 10 is shown which is formed of a frame 12 having a traverse cross-member 14 connected to a pair of opposed tabs 16 which extend substantially perpendicularly from the plane of the traverse cross-member 14. Additionally, a pair of opposed arms 18 also extend substantially perpendicularly from the plane of the cross-member 14 and in the opposite direction from the tabs 16. Roll adapters 22 are located at the distal ends of each of the arms 18. The adapter 10 is of a size such that is fits into the recessed dispensing cavity 96 of an existing dispenser 90. Mounts 24 are located on the outward faces 28 of the tabs 16 such that when the adapter 10 is placed in the recessed dispensing cavity 96 of the existing dispenser 90, as shown in FIG. 1, the mounts 24 attach the tabs 16 of the adapter 10 to the side walls 97 of the recessed dispensing cavity 96. As shown in FIG. 2, the arms 18 and their roll adapters 22 then extend from the dispenser face 92 and are adequately spaced apart to receive a coreless roll for dispensing.

A detailed explanation of the recessed dispenser and components is not necessary of purposes of the present disclosure. Such conventional dispensers have typically been used to dispense rolled product having hollow cores. In such cases, a spindle device is inserted through the hollow cores and engages in each of the spindle recesses 99, as is well understood by those skilled in the art. Examples of conventional dispensers that are useful in the present invention are manufactured by ASI of Yonkers, N.Y.; Bobrick Washroom Equipment, Inc. of Los Angeles, Calif.; Bradley Corporation of Menomonee Falls, Wis.; and McKinney Essex of Scranton, Pa. The dispensers of these companies and others are all similar in operation in that they dispense cored rolled product utilizing a spindle and dispense from a recessed cavity 96.

Figure 3:
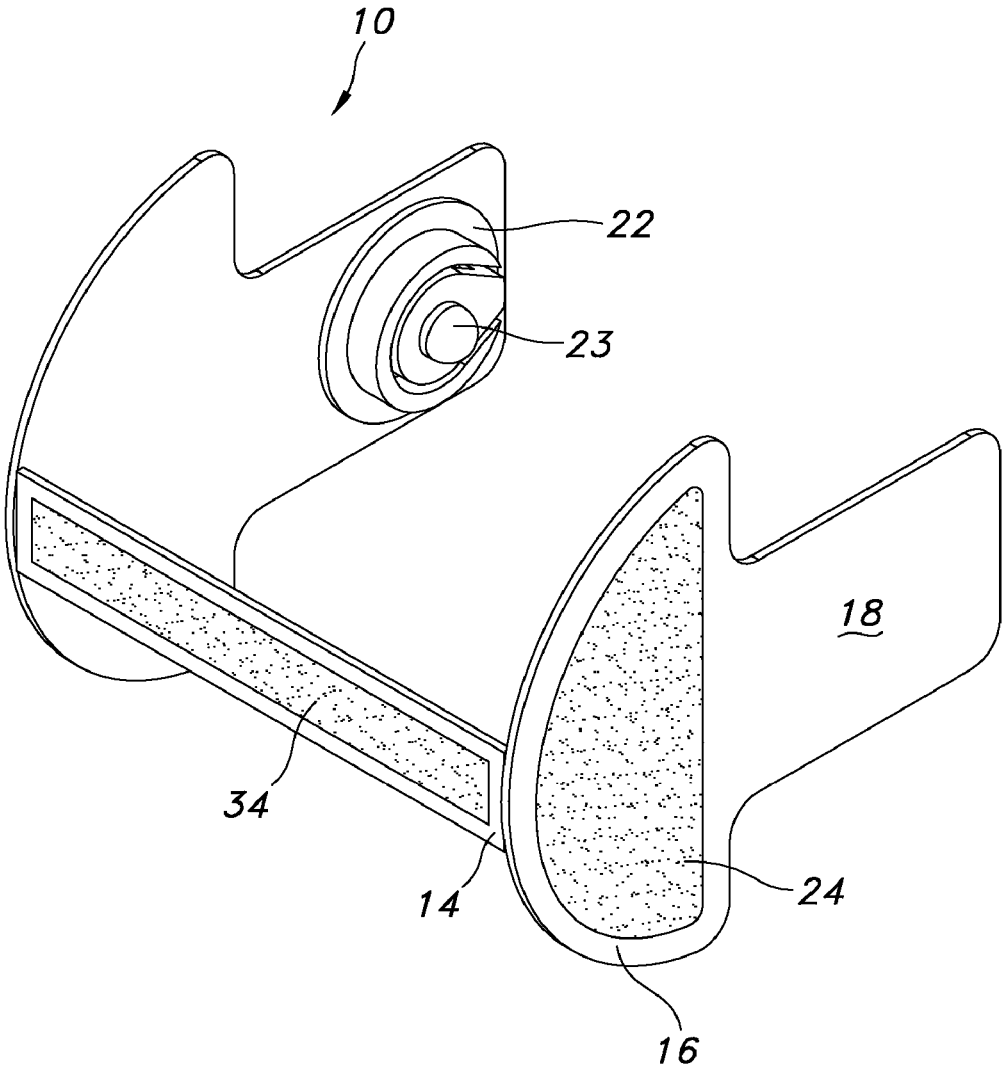
FIG. 3 is a perspective view of another adapter according to the present invention.

As discussed above, the frame 12 is made up of a traverse cross-member 14, a pair of opposed tabs 16, and a pair of opposed arms 18. As shown in FIGS. 1-3, the frame 12 may be a singular piece of material that is adapted to have the desired components and shape. Alternatively, the tabs 16, the arms 18, or both the tabs 16 and arms 18 may be separate pieces that are attached to the traverse cross-member 14. In such instances where separate pieces are joined together, any of the known processes or means for joining such pieces together could be used. For example, separate pieces of the frames could be joined by fasteners, welds, adhesive, interlocking end pieces or other similar methods and means as are known to join the particular pieces and as are appropriate for the materials being used. Whether the frame 12 is made of a singular piece of material or multiple pieces joined together, the frame 12 is intended to be easily installed as a singular adapter 10 into the recessed cavity of an existing recessed dispenser.

The frame 12 may be made any variety of materials that are common for such dispensers and are strong enough to support and dispense the intended coreless roll products. By way of non-limiting example, the frame 12 may be made from stainless steel, aluminum, plastic, composite materials, laminate materials, or the like. Additionally, the various parts of the frame 12 may all be made from the same material or the traverse cross-member 14, the tabs 16, and the arms 18 may each be made from one or more materials. Similarly, the individual parts of the frame 12 may be a single material or they may each be made of more than one material or may be a composite or laminate material.

The larger the intended roll of coreless product that is intended to be dispensed with the adapter 10, the stronger the frame 12 that is required. The flexibility of the frame 12, which is partially a function of the design, the material used, and the thickness of the material, needs to be balanced for the products to be dispensed and the existing dispenser 90 that is being adapted. For example, for wider rolls of coreless product the adapter 10 will have to be designed to have a wider span between the opposed arms 18. One skilled in the art can see that such a wider span will increase the inclination for that the frame 12 to flex between the arms 18. If the frame 12 is allowed to flex too much, the coreless roll product may not adequately be supported by the roll adapters 22 and the roll product may be dislodged from the frame 12.

Likewise, larger diameters of the coreless roll product will require arms 18 that extend further from the frame 12 and increase the probability of arms 18 flexing. One skilled in the art would see that the design of the frame 12, the materials used, and the thickness of the materials could be adapted to the unique features of the existing dispenser 90 and the rolled product that is desired to be dispensed.

Generally, for aesthetic purposes it may be desirable that the material and finish of the frame 12 matches that of the dispenser 90 such that the adapter 10 blends in with the material and finish of the existing recessed dispenser 90. For example, if the existing dispenser 90 is made from stainless steel and has a matte finish it may desirable to make the frame 12 out of stainless steel or aluminum.

The traverse cross-member 14 acts to connect the opposed tabs 16 to each other, provides support for the tabs 16 and the arms 18 of the frame 12, and functions to stabilize the frame 12. Such a traverse cross-member 14 allows the adapter 10 to be easily installed as a single unit in an existing recessed dispenser 90 rather than the inherent complexity that would accompany the installation of multiple individual pieces independently.

Figure 4:
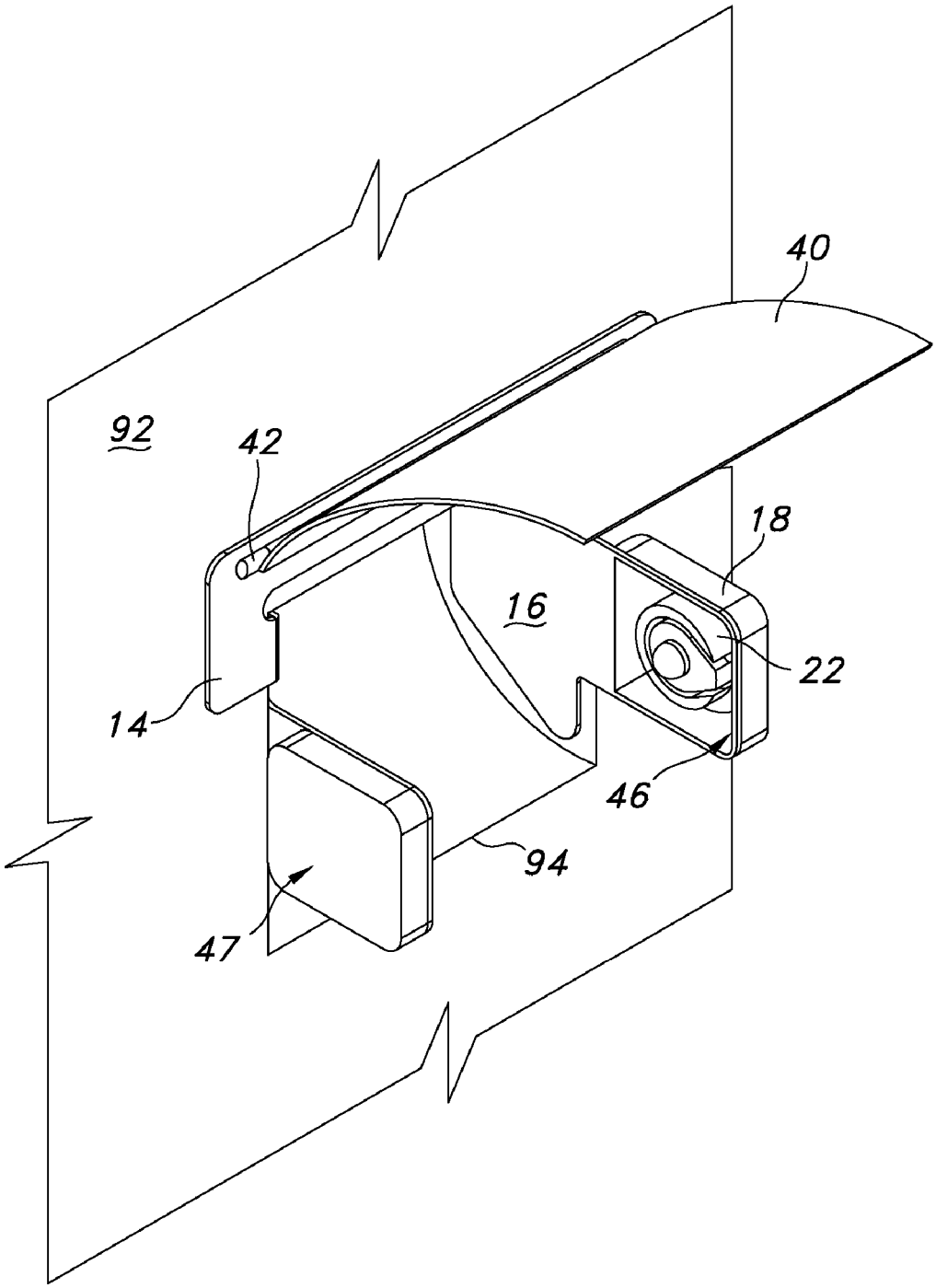
FIG. 4 is a perspective view of another exemplary adapter of the present invention having a roll cover.

The actual dimensions and shape of the traverse cross-member 14 is dependent on the dispenser 90, the roll product intended to be dispensed, and design choice. As shown in FIGS. 1 and 2, the cross-member 14 may lay flush on the face 92 of the existing dispenser 90. Such a design may help seat the adapter 10 in the dispensing cavity 96 and may additionally help secure the adapter 10 by tape, adhesive, magnets, or other similar attachment methods or means on the side of the cross-member 14 that contacts the face 92 of the dispenser 90. Additionally, such a cross-member 14 on the exterior of the recessed dispensing cavity 96 may allow for features such as a roll cover 40, as shown in FIG. 4, to be attached to the adapter 10.

The cross-member 14 is shown in FIGS. 1 and 2 as a single member that extends above and between the tabs 16 of the adapter 10. For additional stability, for aesthetics, design choice, or any combination of such reasons or other reasons, an additional cross-member (not shown) may similarly extend below the tabs 16 of the dispenser. Similarly, the traverse cross-member 14 may be a single frame that extends around the entire opening periphery 94 of the recessed dispensing cavity 96.

Alternatively, as shown in FIG. 3, the cross-member 14 may extend between the tabs 16 on the back side of the adapter 10. When installed within a dispenser 90, such a traverse cross-member 14 would be proximate to the rear wall 98 of the recessed dispensing cavity 96 and would not be visible when the adapter 10 is installed with a coreless roll in place. As shown, the cross-member 14 may have a back mount 34 that would help secure the adapter 10 to the back wall 98 within the recessed dispensing cavity 96. Such a back mount 34 may be double-sided tape, adhesive, magnets, fasteners, or other such similar methods commonly used to join materials to each other.

The adapter 10 may have only a back mount 34 to attach the adapter 10 to the dispenser 90. Alternatively, the adapter 10 may multiple mounts to attach to the dispenser 90. For example, the adapter 10 shown in FIG. 3 has a the back mount 34 and mounts 24 on the tabs 16.

The cross-member 14 shown in FIG. 3 is shown as a single piece extending between the tabs 16. Alternatively, additional cross-members (not shown) may be included above, below, or both above and below the cross-member 14 shown. The cross-member 14 may instead be a larger piece that, along with the tabs 16, could match the size and shape of the recessed dispensing cavity 96. As one skilled in art can see, there are multiple configurations, shapes, and sizes that the cross-member 14 could be to meet the needs of the particular dispenser 90, the rolled product desired to be dispensed and design choice.

The tabs 16 of the adapter 10 are the parts of the frame 12 that extend into the recessed dispensing cavity 96. Such tabs 16 stabilize the frame 12 within the dispensing cavity 96 and may additionally be used to secure the adapter 10 to the dispenser 90. The pair of tabs 16 are opposed to each other with each having an inward surface 26 that faces the coreless roll product to be dispensed and an outward surface 28 that faces and contacts the side walls 97 of the recessed dispensing cavity 96 of the existing dispenser 90.

The tabs 16 are sized to fit within the recessed dispensing cavity 96. The tabs 16 may be designed to match the shape and size of the side walls 97 of the particular dispenser 90 to be adapted, such as shown in FIG. 3, or they have a different size and shape than the side walls 97, as shown in FIGS. 1, 2 and 4. The shape of the tabs 16 may be any shape, symmetrical or asymmetrical, the meets the needs of the particular dispenser 90 to be adapted, the mounting used with the tabs, design choice, or other such reasons. For efficiency, the tabs 16 may be a shape that allows the adapter 10 to be used in multiple styles of recessed dispensers 90.

Additionally, for tabs 16 that are intended to secure the frame 12 to the dispenser 90, the tabs 16 may be sized to have an appropriate amount of surface area to adequately secure the frame 12 to the existing dispenser 90 with enough strength to hold the coreless roll product during dispensing As shown in FIGS. 1 and 3, a mount 24 is associated with the tabs 16 of the adapter 10. The mount 24 attaches the adapter 10 to the existing recessed dispenser 90 such that a coreless roll of product can be secured and dispensed by the adapter 10. The mount 24 may be any method of attachment that are well known and are appropriate for the materials, design of the adapter 10, and the design of the existing recessed dispenser 90 that is being adapted. By way of non-limiting examples, such a mount 24 may be an adhesive, adhesive tape, hook and loop substrates, rivets, screws, nails, or other similar substrates, substances, or fasteners.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together The mount 24 shown in FIGS. 1 and 4 is a double-sided tape present on the outward surface 28 of the tabs 16 that is similar in size to the size of the tab 16. Such an adhesive mount 24 would typically be covered by a peel strip until it is desired to install the adapter 10 in the existing dispenser 90. The mount 24 may be the same approximate size as the tabs 16 or may be any other size or shape such that the mount 24 adequately secures the adapter 10 to the dispenser 90 while the coreless roll product is held by the adapter 10 and is dispensed therefrom.

To help stabilize the adapter 10 and prevent the adapter 10 from easily being pulled out of the dispenser 90, the adapter 10 may additionally may have a pair of mounting protrusions (not shown) that are configured to fit within the spindle recesses 99 of the recessed dispenser 90. Such mounting protrusions may be present on the outward surfaces 28 of the tabs 16.

The pair of opposed arms 18 of the adapter 10 extend the frame 12 outward from the recessed dispensing cavity 96 of the dispenser 90 and allow for a larger diameter roll of coreless product to be dispensed than may be allowed to be dispensed by the existing recessed dispensing cavity 96. For example, standard cored bathroom tissue has a diameter of approximately 4.5 inches (114 mm). Rolls of bathroom tissue having diameters much larger than the standard dimension cannot be dispensed from many existing recessed dispensers due to the dimensions of the dispensing cavity, which are designed for the standard roll dimensions. By using an adapter 10 according to the present invention the user could dispense coreless or solid rolls of bathroom tissue from the same recessed dispensers and would additionally be able to dispense rolls having diameters greater than the standard diameter. The actually diameter of rolls that may be accommodated is determined by the length of the arms 18 of the adapter 10; greater diameters can be dispensed with longer arms 18.

The length of the arms 18 is dependent on the design of the adapter 10 and the diameter of the of the coreless roll product that is desired to be dispensed. The arms 18 may be any shape, symmetrical or asymmetrical, or size that is desired and that meets the needs of the particular dispenser 90 being adapted, the design of the particular adapter 10, and the coreless roll product that is intended to be dispensed.

Roll adapters 22 are present at the distal ends of the arms 18 to hold, support and dispense the coreless roll product. Generally, such roll adapters 22 will have a protrusion 23 that is configured to match up with indentations, or hollowed areas, that define the rotational axis of the rolled product and are present on the opposite sides of a solid or coreless roll. The roll adapters 22 may be any of the designs that are known in the art for securing and dispensing coreless roll product. Such roll adapters 22 may be a single piece, may be various functional shapes, or may be made up of multiple parts. Exemplary roll adapters 23 may be found in U.S. Pat. Nos. 6,082,664 and 6,360,985, both to Phelps et al. and U.S. Pat. No. 6,092,758 to Gemmell.

The design of the arms 18 may be configured to accommodate the roll adapter 22 that is used with a particular adapter 10. For example, as shown in FIGS. 1, 2, 5A, and 5B the arms 18 may have a double bend to accommodate the height the roll adapter 22 extends from the surface of the arms 18 and the width of the coreless roll product that is intended to be dispensed.

Another possibility of such accommodation for the roll adapters 22 is shown in FIG. 4 where the roll adapter 22 is set within a recess 46 in the arm 18 of the adapter 10. Such a recess 46 is accompanied by an associated bulge 47 on the outward surface of the arm 18. The recess 46 may be the same size as the roll adapter 22 to snuggly accommodate the roll adapter 22 or may be larger than the roll adapter 22, such as shown in FIG. 4.

The roll adapters 22 are attached to the arms 18 of the adapter 10 by any method and means as are well known for securely joining the particular materials of the roll adapters 22 and the arms 18 of the adapter 10 such the roll adapter 22 may secure, support and dispense the coreless roll product. Such attachment may be made with adhesives, adhesive tapes, magnets, rivets, screws, fasteners, or other similar substances or methods as are well known.

Additionally, the roll adapter 22 may be designed to interact with the design of the arm 18, to facilitate the installation of the roll adapter 22, to help secure the roll adapter 22 firmly in place during use, or both. For example, the back side of the roll adapter 22 may have indented shape that matches up with a raised matching shape on the surface of the arm 18. Alternatively, a recess 46 on the arm 18 may be uniquely shaped to uniquely fit the shape of a roll adapter 22. Such configuration of roll adapters 22 and arm 18 designs may be used to control the orientation of the roll adapter 22 on the arm 18, may prevent the roll adapter 22 from rotating during dispensing, as a design choice, or for any other combinations of reasons.

Orientation of the roll adapters 22 may be helpful for adapters 10 that use directionally-orientated roll adapters 22. Such directional orientation allows the easy installation of a roll 51 of coreless roll product, but makes it difficult to remove such a roll 51, either intentionally or accidentally, during dispensing. Such directionally-orientated roll adapters 22 are illustrated in FIGS. 5A and 5B.

Figure 5A:
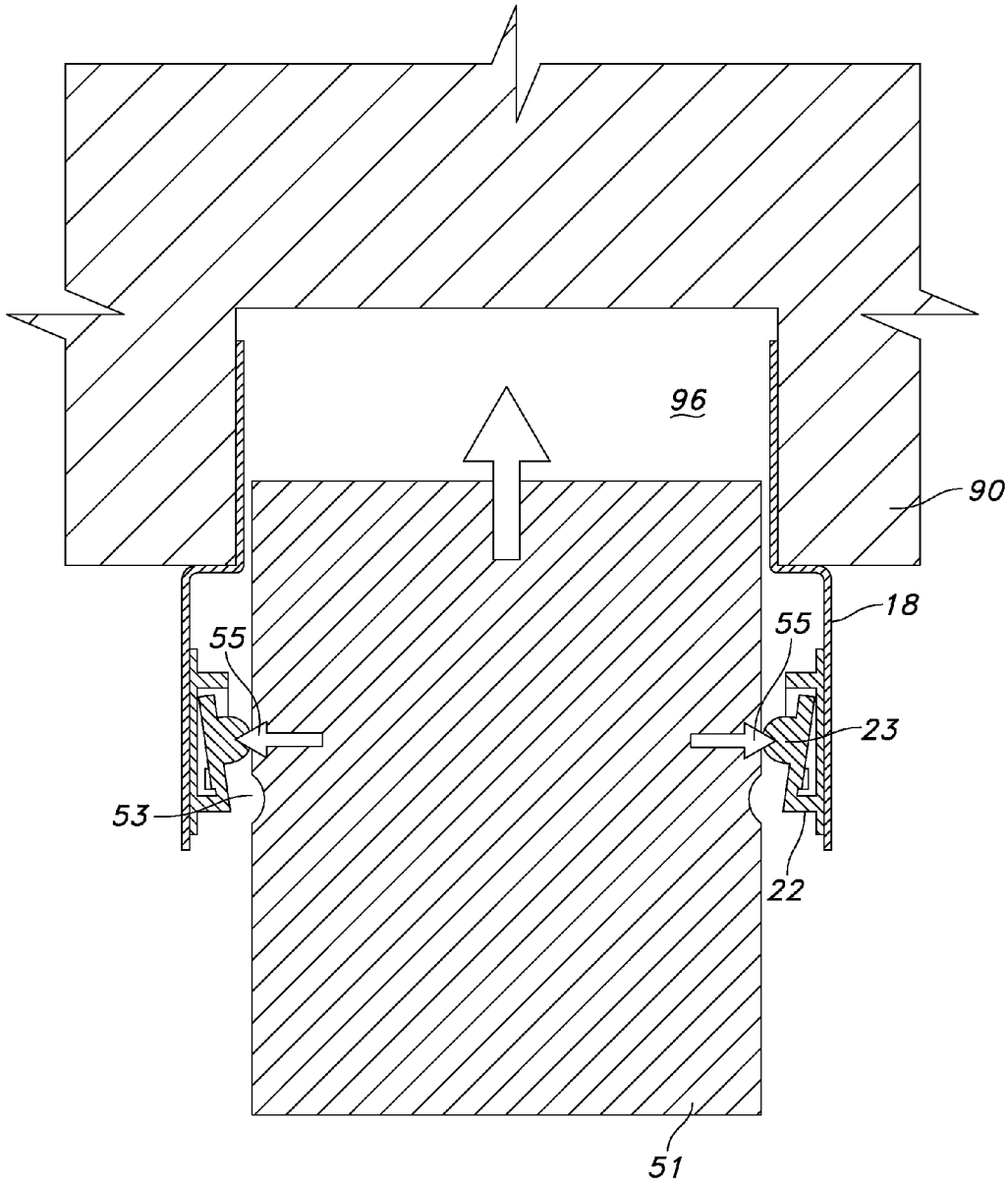
FIG. 5A illustrates a top cross-sectional view of the adapter with the coreless roll product being loaded into the adapter by pushing the roll into the adapter toward the dispensing cavity of the existing recessed dispenser and with the roll applying sideward forces to the flexible projections of the roll adapters.

FIG. 5A shows a top cross-sectional view of a coreless roll 51 in the partially inserted position. As the roll 51 is being instated, the sides of the roll 51 push against the roll adapters 22. The roll adapters 22, in this particular orientated design, are designed such that the protrusion 23 of the roll adapter will deflect as shown in FIG. 5A, while the roll is being inserted in the direction shown. The direction arrows 55 show the direction of the force applied by the roll 51 against the distal ends of the protrusions 23 of the roll adapters 22 during insertion of the roll 51.

Figure 5B:
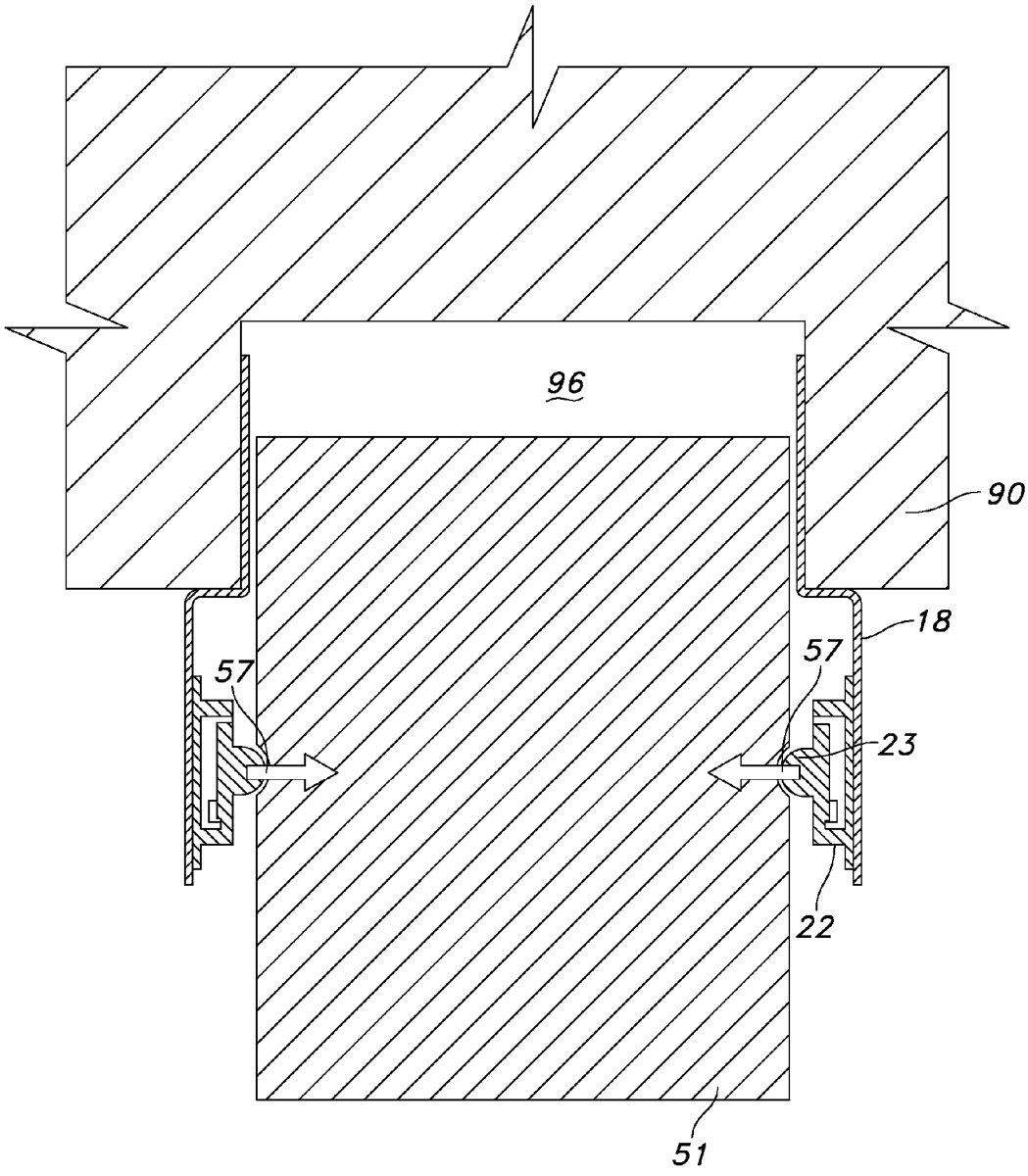
FIG. 5B illustrates the top cross-sectional view of the adapter of FIG. 5A with the coreless roll product having reached its dispensing position, the flexible projections of the roll adapters engaging each side of the roll product.

The indentations 55 on either side of the roll 51 are configured to receive the protrusions 23 when the roll 51 is pushed further into the recessed dispensing cavity 96, as shown in FIG. 5B. In FIG. 5B, the protrusions 23 now have aligned with and are firmly engaging the indentations 55 of the on either side of the roll 51, where the direction arrows 57 show the direction of the force applied by the protrusions 23 of the roll adapters 22. When aligned with the indentations 55, the roll adapters 22 securely supports the roll 51 in the adapter 10. The roll is now held firmly in place in the adapter 10, and typically cannot be removed by simply pulling on the roll in a direction away from the recessed dispensing cavity 96.

FIGS. 5A and 5B illustrate an example of a roll adapter 22 with a protrusion 23 having the ability to flex when a greater opposing force is applied against its distal end during insertion of a rolled product and which also applies force to that rolled product when the greater opposing force is removed during dispensing. The roll adapter 22 shown in FIGS. 5A and 5B is just one type such a roll adapter design. Other roll adapter 22 designs, as are known and as discussed above, may have different configurations, designs, or additional parts that similarly allows the protrusion 23 to displace when a greater opposing force is applied against the distal end of the protrusion 23 while the rolled product is being inserted into the adapter 10. By way of non-limiting examples of roll adapters 22 adapted to displace, the design of the roll adapter 22 may allow the protrusion 23 to flex upon application of force (as in FIGS. 5A and 5B), the roll adapter 22 may incorporate an additional spring piece, or the roll adapter 22 design may incorporate a spring and a protrusion 23 that is allowed to recede into a recess when force is applied to the distal end of the protrusion 23. Such alternate designs of roll adapters 22 having protrusions 23 adapted to displace, may or may not be directionally-oriented, as discussed above.

As shown in FIG. 4, the adapter 10 may additionally include a roll cover 40 to give roll 51 greater protection, or the appearance of greater protection, similar to when the cored roll resided further into the recessed dispensing cavity 96 prior to adapting the dispenser 90. The roll cover 40 may be any size, shape, and design that is desired for the particular adapter 10. The roll cover 40 is attached to the adapter 10 as is appropriate for the adapter 10. As shown in FIG. 4, the roll cover 40 may be attached to the cross-member 14.

The roll cover 40 may be a fixed position, or as shown in FIG. 4, the roll cover 40 may be attached to the adapter 14 by a hinge 42. Such a hinge 42 allows for the roll cover 40 to be lifted up to insert a new roll of coreless roll product and also allows the roll cover 40 to descend with the decrease of the roll diameter as the roll is dispensed. Such a hinge 42 may be any type of jointed or flexible device that connects and permits pivoting or turning of a part to a stationary component, such as are common and well known. Such hinges 42 include, but are not limited to, metal pivotable connectors, such as those used to fasten a door to frame, and living hinges. Living hinges may be constructed from plastic and formed integrally between two members. A living hinge permits pivotable movement of one member in relation to another connected member.

It will be appreciated that the foregoing examples and discussion, given for purposes of illustration, are not to be construed as limiting the scope of this invention, which is defined by the following claims and all equivalents thereto.

I claim:

1. An adapter for solid or coreless roll products that are dispensed from a recessed dispenser having a dispensing cavity defined by an opening periphery, a rear wall, and a pair of side walls that oppose each other and each side wall being proximate to the opposing ends of the roll product to be dispensed, the adapter comprising:

a frame; and a pair of roll adapters attached to the frame, wherein the frame comprises, a pair of tabs that oppose each other, the tabs configured to extend into a recessed dispensing cavity to hold the frame therein, a pair of arms that oppose each other, the arms configured to extend from the tabs and outwards away from such a dispensing cavity, and a traverse cross-member that connects the pair of tabs, and wherein the roll adapters are positioned at the distal ends of the arms and aligned opposite of each other, the roll adapters configured to engage, hold and dispense a solid or coreless roll.

2. The adapter of claim 1, wherein the tabs, arms and cross-member are integrally formed to comprise a single piece of material.

3. The adapter of claim 1, further comprising a mount positioned on each of the tabs, the mounts configured to attach the frame to side walls of a recessed dispensing cavity.

4. The adapter of claim 1, further comprising at least one mount located positioned on the traverse cross-member, wherein the mount is configured to attach the frame to a recessed dispenser.

5. The adapter of claim 1, wherein the arms comprise separate pieces attached to the frame.

6. The adapter of claim 1, further comprising a roll cover attached to the frame and extending outwardly from a recessed cavity.

7. The adapter of claim 6, wherein the roll cover is attached to the frame with a hinge.

8. The adapter of claim 1, wherein each arm further comprises a recess positioned at the distal end of the arm, and wherein the roll adapters fit within said recesses.

9. The adapter of claim 8, wherein each recess directionally aligns the roll adapter within the recess.

10. The adapter of claim 1, wherein each of the roll adapters comprises a protrusion, which is adapted to displace when a greater opposing force is applied against a distal end of the protrusion during loading of a rolled product, and wherein the protrusion is adapted to apply force to a rolled product when the greater opposing force is removed during dispensing of such a rolled product.

11. The adapter of claim 10, wherein the protrusion displaces toward the roll adapter due to directional forces applied during insertion of a rolled product into the adapter, but wherein the protrusion does not displace toward the roll adapter due to directional forces opposite to those applied during insertion of such a rolled product into the adapter.

12. A system for dispensing solid or coreless roll products from a recessed dispenser having a dispensing cavity defined by an opening periphery, a rear wall and a pair of side walls that oppose each other and each side wall being proximate to the opposing ends of the roll product to be dispensed, the system comprising:

a solid or coreless roll of product;

an adapter; and a mount configured to attach the adapter to a recessed dispenser, wherein the adapter comprises a frame and a pair of roll adapters attached to the frame, wherein the frame further comprises a pair of tabs that oppose each other, a pair of arms that oppose each other, and a traverse cross-member that connects the pair of tabs, wherein the tabs are configured to extend into a recessed dispensing cavity to hold the frame therein, wherein the arms are configured to extend from the tabs and outwards away from such a dispensing cavity, and wherein the pair of roll adapters are positioned at the distal ends of the arms and aligned opposite of each other, the roll adapters configured to engage, hold and dispense the solid or coreless roll product.

13. The system of claim 12, further comprising a roll cover attached to the frame and extending outwardly from a recessed cavity.

14. The system of claim 12, wherein the mount is positioned on the tabs.

15. The system of claim 12, wherein the mount is positioned on the traverse cross-member.

16. The system of claim 12, wherein each arm further comprises a recess positioned at the distal end of the arm, and wherein the roll adapters fit within said recess.

17. The system of claim 16, wherein each recess directionally aligns the roll adapter within the recess.

18. The system of claim 12, wherein each of the roll adapters further compries a protrusion, which is adapted to displace when a greater opposing force is applied against a distal end of the protrusion during loading of the roll product, and wherein the protrusion is adapted to apply force to the roll product when the greater opposing force is removed during dispensing of the roll product.

19. The system of claim 18, wherein the protrusion displaces toward the roll adapter due to directional forces applied during insertion of the roll product into the adapter, but wherein the protrusion does not displace toward the roll adapter due to directional forces opposite to those applied during insertion of the roll product into the adapter.

* * * * *